United States Patent [19]

Halilovi

[11] Patent Number: 4,682,896

[45] Date of Patent: Jul. 28, 1987

[54] DEVICE FOR GENERATING VIBRATIONS

[76] Inventor: Esref Halilovi , D. Tucovi a 141, 11000 Beograd, Yugoslavia

[21] Appl. No.: 814,971

[22] Filed: Dec. 31, 1985

[30] Foreign Application Priority Data

Mar. 4, 1985 [YU] Yugoslavia ..... 329/85

[51] Int. Cl.[4] ..... B01F 11/00

[52] U.S. Cl. ..... 366/120; 366/280

[58] Field of Search ..... 366/120, 123, 128, 600, 366/280; 74/87

[56] References Cited

U.S. PATENT DOCUMENTS 3,727,890 4/1973 Seidl et al. ..... 366/123 X 3,746,310 7/1973 Fransson et al. ..... 366/120

4,293,231 10/1981 Lyle ..... 366/120

*Primary Examiner*—Peter Nerbun

*Attorney, Agent, or Firm*—Fleit, Jacobson, Cohn & Price

[57] ABSTRACT

The invention provides a device for generating mechanical vibrations, preferably a sound-type vibrator having a cylindrical housing with a coaxial stationary shaft, on which a sleeve-shaped working body is suspended, driven by a compressed fluid to a vibrating/rolling movement. The free end of the hollow shaft is widened to a cylindrical collar, whereby the inside of the housing is divided into an auxiliary and a main working chamber, between which communication is provided by a coil channel which is foreseen on the mantle surface of the collar. The superimposed radial surfaces of the collar and of the cover of the housing, which surfaces define the main working chamber in its axial direction, are tapered.

4 Claims, 2 Drawing Figures

DEVICE FOR GENERATING VIBRATIONS

Figure 1:
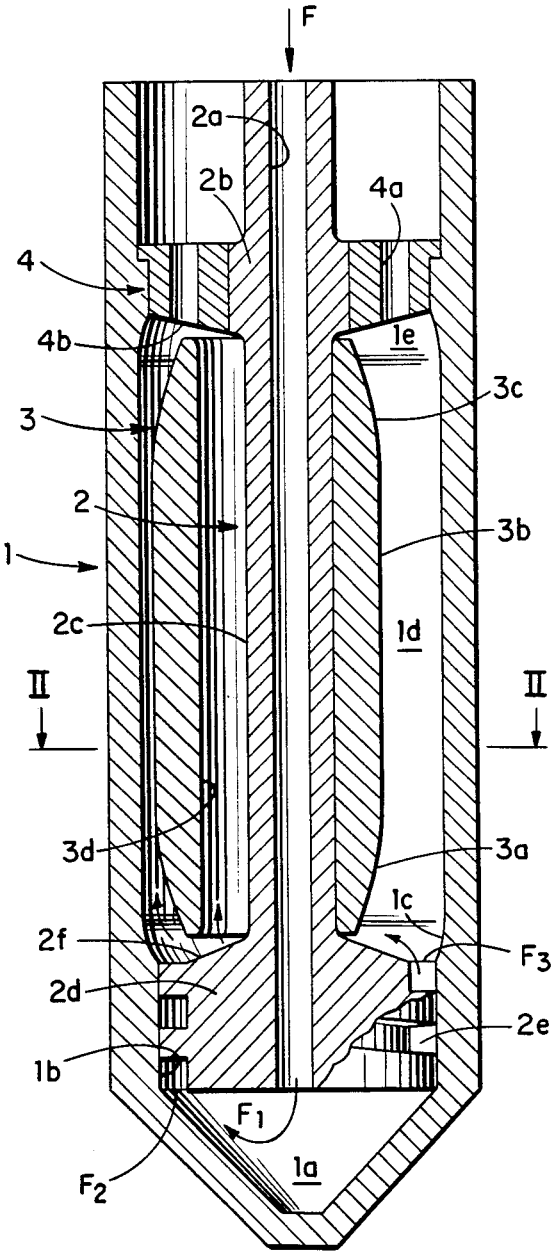

The invention relates to a device for generating vibrations, having a housing of a circular cross-section with a stationary shaft coaxial with it, on which stationary shaft there is suspended a sleeve-shaped working body which is urged in a swinging/rolling motion by means of a compressed fluid which, when exhausted, leaves the inside of the housing in an axial direction. In particular, the invention concerns vibrators to be used e.g. in civil engineering for the activation of components and compositions of constructive mixtures, for local mixing and compacting at the incorporation thereof, or in foundries, chemical and other industries for influencing mixtures, melts, alloys, suspensions, emulsions and the like.

Vibrators having the aforementioned constructional features are known from e.g. Swiss Pat. No. 576,818 (inventors W. Fink et al.) and U.S. Pat. No. 2,960,314 (A. G. Bodine). In both solutions the compressed fluid is introduced into the cylindrical working chamber tangentially to its inner wall surface where it impacts the working sleeve, whose front ends tightly contact the cover plates of the working chamber, in which cover plate(s) there are provided discharge openings for the exhausted fluid.

Due to the fact that the working body must tightly contact the cover plates of the working chamber, a great portion of the introduced energy is transformed by friction to heat and noise, which means a reduction of the efficiency of the vibrators. Extreme requirements also exist concerning the parallelism between the front ends of the working body and the inner surfaces of the cover plates, and the ratio between the length of the working body and the outer diameter thereof must be sufficiently small to prevent blocking of the working body when it tends to tilt with respect to the central shaft.

Because of the above-mentioned drawbacks of the prior art, it has been tried to create a device for the generation of mechanical vibrations, whose (axial) length could be optionally great without the risk of blocking the working body and without the necessity of the above-mentioned parallelism of the abutting surfaces.

Surprisingly, it has been found that the working body need not be precisely guided by its front surfaces provided that the energy of the compressed medium is exploited in an optimum manner. To achieve this aim, the invention provides for the introduction of the fluid axially through the central stationary shaft into an auxiliary chamber of the housing, which chamber is separated from the main working chamber of the vibrator by the end cylindrical collar portion of the shaft, which collar portion is pressed into the housing of the vibrator. Also, on its mantle surface said collar portion is provided with preferably one coil groove, by means of which the communication is restored between the two chambers of the housing. The compressed medium supplied into the auxiliary chamber can thus discharge through the coil groove into the working chamber, which it enters in the direction of the coil groove, i.e. spirally. To support the spiral entry of the fluid into the main chamber, the inner radial surface of the collar is tapered. This feature also cause the working body to be reliably suspended on the central shaft.

Under the conditions explained above, the entering swirling fluid is divided into a first portion streaming outside the working body and a second portion streaming inside the working body. Along the working body the two vortexes of the fluid becomes more and more axially intensified until they discharge from the housing through the discharge holes in a purely axial direction.

As the working body is freely movable inside the working chamber, the outer end sections thereof are contracted so that the working body in no position strikes the cylindrical surface of the working chamber.

In order to provide reliable suspension of the working body on the central shaft, the inner surface of the cover plate of the housing, in which the discharge holes are provided, is tapered as well.

Figure 2:
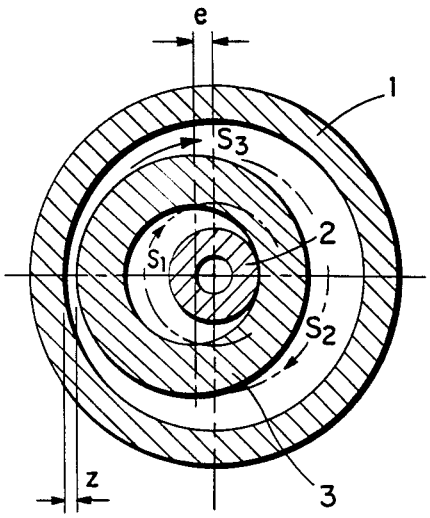

The invention will be described in detail in connection with an illustrative embodiment thereof, reference being made to the accompanying drawing, in which:

FIG. 1 is a longitudinal sectional view of the preferred embodiment of the invention, and FIG. 2 is a transverse section along line II—II of FIG. 1.

The main constructional elements of the proposed vibrator are a housing 1, a shaft 2, a working body 3 and a cover 4.

In the inside, the housing 1 is composed of the following constructional rotational sections: a lower chamber 1*a*, a lower cylinder section 1*b*, a lower widening section 1*c*, a cylindrical section 1*d* and an upper contracting section 1*e*.

The shaft 2 comprises the following main constructional details: a central hole 2*a*, an upper collar 2*b*, a rolling surface 2*c* and a lower collar 2*d*.

On the outer cylindrical surface of the lower collar 2*d* there is provided a cylindrical spiral channel 2*e*, and the upper surface of the collar 2*d* is formed as a tapered surface 2*f*.

The working body 3 is shaped as a sleeve having the following main details: a lower contracted section 3*a*, a cylindrical section 3*b*, an upper contracted section 3*c* and a rolling surface 3*d*. All mentioned details of the working body 3 are mutually coaxial.

The cover 4 comprises the following constructional details: delivering holes 4*a* and a tapered surface 4*b*.

By means of its outer cylindrical surface, the lower collar 2*d* of the shaft 2 is forced in the lower cylindrical section 1*b* of the housing 1. In the assembled state the shaft 2 and the housing 1 form an inseparable working unit, wherein the axes of all circular room sections of the housing 1 as well as that of the shaft 2 are in alignment. From above the working chamber of the vibrator is closed by the cover 4, against which there abuts tightly the upper collar 2*b* of the shaft 2. On the other hand, the cover 4 by its outer cylindrical surface abuts tightly against the housing 1.

The intake of the compressed working fluid begins at F where the vibrator is connected to a working fluid source. Thereupon the fluid streams along the inner hole 2*a* of the shaft 2 to the lower chamber 1*a* of the housing 1, which enters at $F_1$. From said lower chamber the fluid flows through the cylindrical spiral channel 2*e* of the shaft 2 and along this channel it gets accelerated from the entering $F_2$ of the channel to its orifice $F_3$, where the fluid discharges in a directed manner under great speed into the lower widening section 1*c* of the housing 1.

In addition, the stream of the fluid discharging from the cylindrical spiral channel 2*e* of the shaft 2 in the form of an intensive tangential component expands and gets accelerated within the lower widening section 1*c* of the housing 1 where it generates an intensive vortex, which rises by simultaneously intensifying the axial component of the streaming, which is stabilized within the upper contracting section 1*e* of the housing 1, wherefrom the exploited fluid discharges through the delivering holes 4*a* of the cover 4.

Said vortex of the fluid in the housing 1 draws the working body 3 radially to the periphery until it strikes, by its rolling surface 3*d*, the rolling surface 2*c* of the shaft 2. From this moment on, the working body 3 gets accelerated to a limit speed of circulation performing a planetary movement by rolling on the rolling surface 2*c* of the shaft 2. During this action the working body 3 is axially freely accommodated on the rolling surface 2*c* of the shaft 2, which surface is longer than the axial length of the working body 3 for the extent of a working axial gap. Since the pressure of the vortex on the lower contracted section 3*a* of the working body 3 is greater than the pressure of the vortex in the area of the upper contracted section 3*c* of the working body 3 provided that the vibrator is in normal vertical working position, the pressure difference of the vortexes tends to raise the working body 3 and neutralize its weight so that the working body 3 is suspended without striking the neighbouring elements by its front surfaces. In all other possible states and working positions of the vibrator, such as starting, accelerating, the normal operation and stopping, however, the working body 3 exerts a minimum resistance to moving on the front surfaces because it is always led either by means of the tapered surface 2*f* of the shaft 2 or by means of the tapered surface 4*b* of the cover 4 onto the rolling surface 2*c* of the shaft 2, in which case there appears practically no more contact between the front surfaces of the working body 3 and the neighbouring front elements.

In the course of its planetary movement, the working body 3 rotates around its own axis as well as it circulates around the axis of the shaft 2 at a distance e. By said circulation the working body 3 generates a rotational excitation force, which is transmitted by the rolling surface 3*d* of the working body 3 onto the rolling surface 2*c* of the shaft 2. In the operation the outer cylindrical section 3*b* of the working body 3 is throughout distanced from the cylindrical section 1*d* of the housing 1 for a characteristic gap z.

The working body 3 is driven by the described vortex of the working fluid as follows:

In the lower widening section 1*c* of the housing 1 the flow formation gets divided: one stream circulates, urges and draws the working body 3 around the outer side thereof, and the other stream passes through the hole of the working body 3 and draws the urges the cylindrical rolling surfaces 3*d* of the working body 3. Both kinetical (dynamic) components of the vortex generate a one-way moment of rotation (i.e. a dikinetical effect of drawing) of the working body 3, i.e. from the outer and the inner side.

FIG. 2 schematically shows the characteristic action of three flows of the vortex:

The flow $S_1$ flows through the working body 3; at the inlet into the working body 3 it draws, on the basis of vacuum action, the rolling surface 3*d* of the working body 3 and immediately thereafter it gets retarded by streaming along the same rolling surface and urges it.

The flow $S_2$ flows on the outer side of the working body 3 and urges and draws it in the direction of the gap z.

The flow $S_3$ beyond the gap z gets separated from the working body 3 and draws it on the basis of the vacuum generated thereby.

The double propelling draw of the working body 3, i.e. the draw appearing from the outer as well as from the inner side, is also one of the characteristics of the dikinetical vibrator.

The constant flowing of the working fluid, which is subjected to insignificant resistances, as well as extremely low resistances to movement of the working body 3, make it possible, under consideration of the powerful double draw by means of the fluid, to achieve high frequencies and high excitation forces of the vibrator under a minimum expenditure of the energy of the fluid.

The material of the vibrator stands high excitation forces relatively well because the excitation force is transmitted by means of full and large rolling surfaces 2*c* and 3*d* of the shaft 2 and the working body 3 respectively, on which the contact stress is advantageously distributed.

I claim:

1. Device for generating vibrations, having a housing of a circular cross-section with a stationary shaft coaxial with it, on which stationary shaft there is suspended a sleeve-shaped working body, which is urged in swinging/rolling motion by means of a compressed fluid which, when exhausted, leaves the inside of the housing in axial direction, said housing including a cover, wherein the stationary shaft (2) is shaped as a hollow shaft and is provided at its free end with a cylindrical collar section (2*d*), which is pressed into the housing (1) to divide the inside thereof into an auxiliary chamber (1*a*) and a main working chamber (1*c*, 1*d*, 1*e*), which chambers communicate by at least one coil chamber (2*e*) which is provided on a mantle surface of the cylindrical collar section (2*d*), the inner radial surface of which is tapered and stimulates the working body (3), whose (axial) length is smaller than that of the working chamber (1*c*, 1*d*, 1*e*), to be suspended on the shaft (2).

2. Device according to claim 1, wherein the working chamber of the housing (1) is composed of a widening section (1*c*) next to the cylindrical collar section (2*d*), a contracting section (1*e*) next to the cover (4) of the housing (1), and a cylindrical section (1*d*) between the widening and contracting sections (1*c*, 1*e*).

3. Device according to claim 1, wherein the working body (3) is composed of an intermediate cylindrical section (3*b*) accompanied by contracted end sections (3*a*, 3*c*).

4. Device according to claim 1, wherein also the inner radial surface of the cover (4) is tapered, which taper is contrary to the taper of the cylindrical collar section (2*d*).

* * * * *

UNITED STATES PATENT AND TRADEMARK OFFICE

CERTIFICATE OF CORRECTION

PATENT NO. : 4,682,896

DATED : July 28, 1987

INVENTOR(S) : Esref Halilovic

It is certified that error appears in the above-identified patent and that said Letters Patent is hereby corrected as shown below:

On the title page inventor's name should read -- Ešref Halilović --.

On the title page Item (76) "Tucovi a" should read -- Tucovica --.

Signed and Sealed this

Nineteenth Day of January, 1988

*Attest:*

DONALD J. QUIGG

*Attesting Officer*

*Commissioner of Patents and Trademarks*